US007561839B2

(12) United States Patent
Ishida

(10) Patent No.: US 7,561,839 B2
(45) Date of Patent: Jul. 14, 2009

(54) IMAGE FORMING APPARATUS AND IMAGE FORMING METHOD

(75) Inventor: Haruhiko Ishida, Minato-ku (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 111 days.

(21) Appl. No.: 11/758,779

(22) Filed: Jun. 6, 2007

(65) Prior Publication Data

US 2008/0304876 A1 Dec. 11, 2008

(51) Int. Cl.
*G03G 15/01* (2006.01)

(52) U.S. Cl. ..... 399/298; 399/299; 399/302

(58) Field of Classification Search ..... 399/298, 399/299, 302

See application file for complete search history.

(56) References Cited

U.S. PATENT DOCUMENTS 5,087,945 A 2/1992 Randall
5,845,185 A * 12/1998 Sakagami et al. ..... 399/302
2005/0036811 A1* 2/2005 Matsuoka ..... 399/384

FOREIGN PATENT DOCUMENTS

JP 2001-331009 11/2001
JP 2002-040741 2/2002
JP 2003-316106 11/2003

* cited by examiner

*Primary Examiner*—Ali Alavi
*Assistant Examiner*—Evan Dzierzynski
(74) *Attorney, Agent, or Firm*—Turocy & Watson, LLP

(57) ABSTRACT

An image forming apparatus according to the present invention includes a first toner-image forming unit that forms a first monochrome toner image, a first intermediate transfer drum onto which the first monochrome toner image is transferred, a first transfer unit that transfers the first monochrome toner image from the first intermediate transfer drum onto first recording paper, a second toner-image forming unit that forms a second monochrome toner image substantially simultaneously and in parallel with the formation of the first toner image, a second intermediate transfer drum onto which the second monochrome toner image is transferred, a second transfer unit that transfers the second monochrome toner image from the second intermediate transfer drum onto second recording paper, and a paper feeding unit that feeds the first recording paper and the second recording paper to the first transfer unit and the second transfer unit, respectively, substantially simultaneously and in parallel with each other.

13 Claims, 6 Drawing Sheets

IMAGE FORMING APPARATUS AND IMAGE FORMING METHOD

BACKGROUND OF THE INVENTION

1. Field of the Invention

The present invention relates to an image forming apparatus and an image forming method, and, more particularly to an image forming apparatus and an image forming method for performing color printing and monochrome printing according to an electrophotographic system.

2. Description of the Related Art

When color printing is performed using the electrophotographic system, a method of superimposing images of four colors, Y (Yellow), M (Magenta), C (Cyan), and K (black), to form a full-color image is often used. As a system for forming color images of four colors and superimposing the color images, there are a four-rotation system, a tandem system, a system that uses plural transfer drums, and the like.

As the method of forming color images using plural transfer drums, for example, as disclosed in U.S. Pat. No. 5,087,945, there is a system that uses four image forming units and two transfer drums. In this system, images (e.g., a Y image and an M image) formed by two image forming units, respectively, are superimposed on each other to form a first two-color image (a Y+M image) on a first transfer drum. On the other hand, images (e.g., a C image and a K image) formed by the other two image forming units, respectively, are superimposed on each other to form a second two-color image (a C+K image) on a second transfer drum. The first two-color image is transferred from the first transfer drum onto the second transfer drum to form a full-color image (a Y+M+C+K image) on the second transfer drum. Thereafter, the full-color image on the second transfer drum is transferred onto recording paper.

Besides, an image forming apparatus that uses four image forming units and three transfer drums is also known. The transfer drums of this system include two first-stage transfer drums (first and second transfer drums) and one second-stage transfer drum (a third transfer drum). Two-color images (e.g., a Y+M image and a C+K image) are transferred onto the two first-stage transfer drums, respectively, from two image forming units corresponding thereto. The two-color images on the first and second transfer drums are transferred to be superimposed on each other on the second-stage transfer drum (the third transfer drum) to form a full-color image (a Y+M+C+K image) on the third transfer drum. Thereafter, the full-color image is transferred onto recording paper.

The system that uses two or three transfer drums (hereafter referred to as plural transfer drum system) and the tandem system are systems for forming plural color images substantially simultaneously to superimpose the color images one on top of another. Compared with the four-rotation system for sequentially forming each color image in every rotation of a transfer drum to superimpose color images formed one on top of another, it is possible to print a color image at high speed.

On the other hand, when monochrome images are printed using color image forming apparatuses of these systems, a system for using only an image forming unit for one color of black (K) has been often used.

When monochrome printing is performed by the color image forming apparatus of the four-rotation system, since an image of K is formed in one rotation of the transfer drum, in principle, printing speed is improved by four fold compared with the color printing.

On the other hand, since the plural transfer drum system and the tandem system are originally systems for forming plural color images substantially simultaneously to superimpose the color images one on top of another, printing speed is not very different in the color printing for plural colors (e.g., four colors) and the monochrome printing for one color.

When it is attempted to improve speed of the monochrome printing in the image forming apparatus of the plural transfer drum system and the tandem system in the past, it is inevitable to substantially change types and structures of components used in the image forming apparatuses and details of image formation processing during the color printing and during the monochrome printing. This makes it inconvenient for users to handle the apparatuses and causes an increase in cost of the apparatuses.

SUMMARY OF THE INVENTION

The present invention has been devised in view of the circumstances and it is an object of the prevent invention to provide an image forming apparatus and an image forming method that can improve, in an image forming apparatus that forms color images using plural transfer drums, speed of monochrome printing without substantially changing types and structures of components used in the image forming apparatus or details of image formation processing during color printing and during monochrome printing.

In order to attain the object, an image forming apparatus according to the present invention includes a first toner-image forming unit that forms a first monochrome toner image, a first intermediate transfer drum onto which the first monochrome toner image is transferred, a first transfer unit that transfers the first monochrome toner image from the first intermediate transfer drum onto first recording paper, a second toner-image forming unit that forms a second monochrome toner image substantially simultaneously and in parallel with the formation of the first toner image, a second intermediate transfer drum onto which the second monochrome toner image is transferred, a second transfer unit that transfers the second monochrome toner image from the second intermediate transfer drum onto second recording paper, and a paper feeding unit that feeds the first recording paper and the second recording paper to the first transfer unit and the second transfer unit, respectively, substantially simultaneously and in parallel with each other.

In order to attain the object, an image forming method according to the present invention includes the steps of (a) forming a first monochrome image, (b) transferring the formed first monochrome image onto a first intermediate transfer drum, (c) transferring, in a first transfer unit, the transferred first monochrome toner image from the first intermediate transfer drum to first recording paper, (d) forming a second monochrome toner image substantially simultaneously and in parallel with the formation of the first toner image, (e) transferring the formed second monochrome image onto a second intermediate transfer drum, (f) transferring, in a second transfer unit, the transferred second monochrome image from the second intermediate transfer drum onto second recording paper, and (g) feeding the first recording paper and the second recording paper to the first transfer unit and the second transfer unit, respectively, substantially simultaneously and in parallel with each other.

DESCRIPTION OF THE EMBODIMENTS

Embodiments of an image forming apparatus and an image forming method according to the present invention will be explained with reference to the accompanying drawings.

Figure 1:
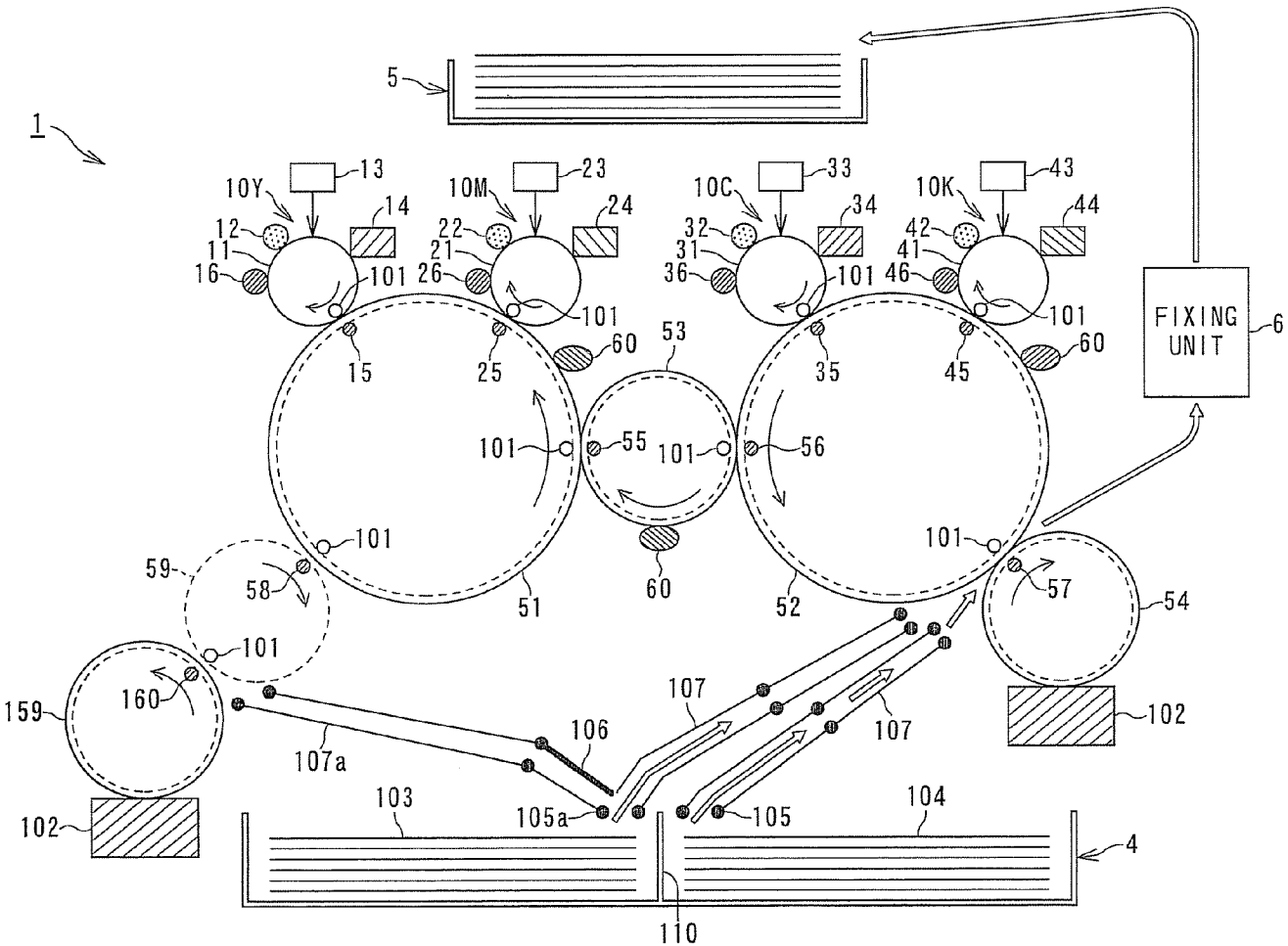
FIG. 1 is a diagram showing an example of a structure at the time when a color printing unit is mounted in an image forming apparatus according to a first embodiment of the present invention.

(1) A Structure and Operations of an Image Forming Apparatus at the Time when a Color Printing Unit is Mounted FIG. 1 is a diagram showing an example of a structure of an image forming apparatus 1 according to a first embodiment. The image forming apparatus 1 is the image forming apparatus 1 that can perform color printing and monochrome printing using an electrophotographic system and is, for example, a copy machine or a complex machine called an MFP (Multi-Function Peripheral).

In the image forming apparatus 1 according to this embodiment, a color printing unit 2 (see FIG. 3) and a monochrome printing unit 3 (see FIG. 4) are interchangeable. When the color printing unit 2 is mounted, full-color printing is possible. When the monochrome printing unit 3 is mounted, it is possible to perform the monochrome printing at high speed.

FIG. 1 shows an example of a structure at the time when the color printing unit 2 is mounted.

The image forming apparatus 1 has first to fourth toner-image forming units 10Y, 10M, 10C, and 10K. These four toner-image forming units 10Y, 10M, 10C, and 10K form a Y (Yellow) image (a first color toner image), an M (Magenta) image (a second color toner image), a C (Cyan) image (a third color toner image), and a K (black) image (a fourth color toner image) on surfaces of photoconductive drums 11, 21, 31, and 41 built therein, respectively.

The image forming apparatus 1 has three intermediate transfer drums, i.e., a first color intermediate transfer drum 51, a second color intermediate transfer drum 52, and a third intermediate transfer drum 53. Besides, the image forming apparatus 1 has a paper feeding unit 4, a second transfer roller 54, a fixing unit 6, and a paper discharge tray 5.

The Y image, the M image, the C image, and the K image formed on the first to fourth toner-image forming units 10Y, 10M, 10C, and 10K, respectively, are sequentially transferred onto the three intermediate transfer drums (the transfer will be described in detail later). Finally, a full-color toner image is formed on the second color intermediate transfer drum 52. This full-color toner image is transferred onto recording paper 104 (or 103) conveyed from the paper feeding unit 4 while the full-color toner image passes a nip section formed by the second color intermediate transfer drum 52 and the second transfer roller 54. The transferred full-color toner image is fixed on the recording paper 104 (or 103) in the fixing unit 6 and discharged to the paper discharge tray 5.

The above is a schematic structure of the image forming apparatus 1 and a rough flow of a color printing operation.

A cored bar roller 59 and a first transfer roller 159 are components used during the monochrome printing. Structures and operations of these rollers will be described later.

Detailed structure of the respective units will be explained.

The first to fourth toner-image forming units 10Y, 10M, 10C, and 10K have the same structure and perform the same operations except that only colors of toner images formed by the toner-image forming units are different. Thus, a structure and operations of the first toner-image forming unit 10Y will be explained as an example.

The first toner-image forming unit 10Y includes, in the center thereof, a photoconductive drum 11 that is rotatable in an arrow direction shown in the figure. In the photoconductive drum 11, an organic photoconductive layer having a thickness of about 20 μm is provided on, for example, a surface of a cylindrical member made of aluminum and having a diameter of about 20 mm.

Around the photoconductive drum 11, a roller charging device 12, an exposing device 13, a developing device 14, a first color intermediate transfer drum 51, a cleaning supporting device 16, and a charge removing device (not shown) are disposed along a rotating direction.

The charging device 12 is a device for uniformly charging the photoconductive drum 11 at a predetermined negative potential.

The charging device 13 is a device for irradiating a laser beam or an LED beam, which corresponds to information of an image to be formed, on the photoconductive drum 11 to form an electrostatic latent image thereon. The exposing device 13 according to this embodiment is, for example, an LED exposing device in which a predetermined number of very small LEDs are arrayed in an axial direction (a main scanning direction) of the photoconductive drum 11. The exposing device 13 can realize a resolution of about 1200 dpi.

The developing device 14 is a device that supplies a developing agent containing a toner as a main component to the electrostatic latent image on the photoconductive drum 11 and reversely develops the electrostatic latent image. A two-component developing agent containing a Y toner as a main component is stored in the developing device 14. The electrostatic latent image on the photoconductive drum 11 is developed by the developing device 14 and the Y image (the first color toner image) is formed on the photoconductive drum 11.

In the same manner, the M image (the second color toner image) is formed on the photoconductive drum 21 by the developing device 24, the C image (the third color toner image) is formed on the photoconductive drum 31 by the developing device 34, and the K image (the fourth color toner image) is formed on the photoconductive drum 41 by the developing device 44.

The first color intermediate transfer drum 51 is constituted by winding a polyimide resin sheet mixed with carbon on a metal drum. The diameter of the metal drum is about 50 mm and an average thickness of the polyimide resin sheet is about 100 μm.

When the first color intermediate transfer drum 51 comes into contact with the photoconductive drum 11 at a predetermined pressure, an area slightly bent along an external shape of the photoconductive drum 11 is formed in a contact section of the first color intermediate transfer drum 51. This bent area is called a contact nip section. A first transfer device 15 is arranged on a surface on an inner side of the first color intermediate transfer drum 51 in the contact nip section.

The first transfer device 15 is a roller-like transfer device that rotates following the rotation of the first color intermediate transfer drum 51. The first transfer device 15 is, for example, an elastic roller of urethane rubber. By mixing carbon resin in this urethane rubber, an electric resistivity of the first transfer device 15 is lowered to about $10^{10}$ ohm·cm and shows semi-conductivity.

Further on a downstream side in the rotating direction of the first color intermediate transfer drum 51, the cleaning supporting device 16 that removes a toner remaining on the surface of the photoconductive drum 11 is provided. The cleaning supporting device 16 is constituted by, for example bonding a sponge-like member formed of urethane rubber or the like on an aluminum shaft. In the image forming apparatus 1 according to this embodiment, a cleaner-less process is adopted. Therefore, the cleaning supporting device 16 scrapes off a residual toner and temporarily stores the residual toner as a waste toner. By applying a predetermined voltage to the aluminum shaft from a not-shown power supply, the waste toner temporarily stored is returned onto the photoconductive drum 11. The waste toner returned onto the photoconductive drum 11 is carried from the first color intermediate transfer drum 51 to the second color intermediate transfer drum 52 through the third color intermediate transfer drum 53 and finally carried onto the second transfer roller 54. The waste toner is scraped off from a surface of the second transfer roller 54 by a blade (not shown) and collected in a waste toner box 102.

In this way, the carrying of the waste toner is performed in the same manner as carrying (transfer) of a normal toner image. However, the carrying of the waste toner is performed using an area such as a space between images to prevent an image from being affected by the carrying.

Further on the downstream side of the cleaning supporting device 16, the not-shown charge removing device is provided. The charge removing device includes a lamp that radiates light of a predetermined wavelength. Light of this lamp is irradiated on the surface of the photoconductive drum 11 and a potential remaining on the photoconductive drum 11 is removed.

With these components around the photoconductive drum 11, it is possible to sequentially form the Y image on the photoconductive drum 11.

In the same manner, the M image (the second color toner image) is formed on the photoconductive drum 21 of the second toner-image forming unit 10M, the C image (the third color toner image) is formed on the photoconductive drum 31 of the third toner-image forming unit 10C, and the K image (the fourth color toner image) is formed on the photoconductive drum 41 of the fourth toner-image forming unit 10K.

A flow of processing until the respective toner images (the Y image, the M image, the C image, and the K image) are transferred onto the three intermediate transfer drums 51, 52, and 53 and a full-color image is finally formed on the second color intermediate transfer drum 52 will be explained.

First, the M image formed on the photoconductive drum 21 is carried to a contact nip section in contact with the first color intermediate transfer drum 51 by the rotation of the photoconductive drum 21. In this contact nip section, a predetermined bias voltage, for example, a bias voltage of about +1000 V is applied to a second transfer device 25 provided on a rear side of the first color intermediate transfer drum 51 and the M image is transferred from the photoconductive drum 21 to the first color intermediate transfer drum 51.

The transferred M image moves to the contact nip section of the photoconductive drum 11 according to the rotation of the first color intermediate transfer drum 51. In this contact nip section, the first transfer device 15 is provided on the rear side of the first color intermediate transfer drum 51. A bias voltage of about +1000 V is also applied to this first transfer device 15 and the Y image on the photoconductive drum 11 is transferred onto the first color intermediate transfer drum 51.

In this case, the Y image is transferred to be superimposed on the M image such that positional deviation is minimized with respect to the M image already transferred on the first color intermediate transfer drum 51. This positioning is performed according to, for example, adjustment of exposure timings of the exposing device 23 and the exposing device 13 (timing for forming electrostatic latent images on each of the photoconductive drums 11 and 21).

As a result of the superimposition of the Y image and the M image, a (Y+M) image is formed on the first color intermediate transfer drum 51.

The Y image and the M image formed on the photoconductive drums 11 and 21 are non-reverse images (images in a direction in which the images should be printed on recording paper), respectively, and the (Y+M) image transferred to be superimposed on the first color intermediate transfer drum 51 is a reverse image obtained by reversing the non-reverse images.

On the other hand, a (C+K) image is formed on the second color intermediate transfer drum 52 in the same manner.

Specifically, first, the K image formed on the photoconductive drum 41 is carried to a contact nip section in contact with the second color intermediate transfer drum 52 according to the rotation of the photoconductive drum 41. In this contact nip section, a bias voltage of about +1000 V is applied to a fourth transfer device 45 provided on a rear side of the second color intermediate transfer drum 52 and the K image is transferred from the photoconductive drum 41 to the second color intermediate transfer drum 52.

The transferred K image moves to a contact nip section of the photoconductive drum 31 according to the rotation of the second color intermediate transfer drum 52. In this contact nip section, a third transfer device 35 is provided on the rear side of the second color intermediate transfer drum 52. A bias voltage of about +1000 V is also applied to this third transfer device 35 and the C image on the photoconductive drum 31 is transferred onto the second color intermediate transfer drum 52.

In this case, as in the above case, the C image is transferred to be superimposed on the K image such that positional deviation is minimized with respect to the K image already transferred on the second color intermediate transfer drum 52. This positioning is also performed according to adjustment of exposure timings of the exposing device 43 and the exposing device 33 (timing for forming electrostatic latent images on each of the photoconductive drums 41 and 31).

As a result of the superimposition of the C image and the K image, a (C+K) image is formed on the second color intermediate transfer drum 52. The C image and the K image formed on the photoconductive drums 31 and 41 are also non-reverse images, respectively, and the (C+K) image transferred to be superimposed on the second color intermediate transfer drum 52 is a reverse image.

What plays a role of superimposing the (Y+M) image transferred onto the first color intermediate transfer drum 51 and the (C+K) image transferred onto the second color intermediate transfer drum 52 is a third color intermediate transfer drum 53 provided between the two intermediate transfer drums.

The (Y+M) image on the first color intermediate transfer drum 51 moves to a contact nip section with the third color intermediate transfer drum 53 according to the rotation thereof. A transfer device 55 having substantially the same structure as the first transfer device 15 and the like is provided in this contact nip section. A voltage causing a potential difference of about 1000 V with respect to a voltage at the first color intermediate transfer drum 51 (i.e., a voltage about 1000 V higher than that at the first color intermediate transfer drum 51) is applied to this transfer device 55. The (Y+M) image is transferred from the first color intermediate transfer drum 51 to the third color intermediate transfer drum 53. The (Y+M) image on the third color intermediate transfer drum 53 is a non-reverse image.

The (Y+M) image transferred onto the third color intermediate transfer drum 53 rotates and moves to a contact nip section with the second color intermediate transfer drum 52. In this contact nip section, the (Y+M) image is transferred onto the second color intermediate transfer drum 52 by a transfer device 56. In this case, the (Y+M) image is transferred to be superimposed on the (C+K) image such that positional deviation is minimized with respect to the (C+K) image already transferred on the second color intermediate transfer drum 52. This positioning is performed by adjusting exposure timing of a combination of the exposing device 43 and the exposing device 33 and exposure timing of a combination of the exposing device 23 and the exposing device 13 in advance.

As a result of the superimposition of the (Y+M) image on the (C+K) image, a (Y+M+C+K) image, i.e., a full-color toner image is formed on the second intermediate color transfer drum 52.

The (Y+M) image transferred onto the second color intermediate transfer drum 52 is a reverse image. The (Y+M+C+K) image generated by superimposing the reverse images, i.e., the (Y+M) image and the (C+K) image, on each other is also a reverse image.

The transfer process described above will be explained in detail. First, a detailed process in which toner images are formed on the respective photoconductive drums will be explained with the photoconductive drum 11 as an example.

The photoconductive drum 11 is driven to rotate by a driving system described later. An outer circumferential surface thereof moves at speed of, for example, about 50 mm/second. The photoconductive drum 11 is charged at a surface potential of, for example, about −500 V by the roller charging device 12. The roller charging device 12 is made of, for example, urethane rubber. The roller charging device 12 comes into contact with the photoconductive drum 11 to be driven following the photoconductive drum 11. A not-shown charging voltage power supply is connected to the roller charging device 12 and a voltage of, for example, about −1050 V is applied thereto.

The surface of the photoconductive drum 11 is formed of an organic photoconductor. The photoconductor usually shows a high resistance but has a characteristic that, when light is irradiated thereon, a specific resistance of an irradiated portion falls. Therefore, when light corresponding to image information is irradiated from the exposing device 13 on the surface of the photoconductive drum 11 via a not-shown optical system, a potential in an irradiate portion falls and an electrostatic latent image is formed on the surface of the photoconductive drum 11. More specifically, a specific resistance of the portion on which the light is irradiated falls and charges on the surface of the photoconductive drum 11 in that portion flow to a base layer side. On the other hand, charges in a portion on which the light is not irradiated remain on the surface. A charge pattern, i.e., an electrostatic latent image, is formed on the surface of the photoconductive drum 11.

The electrostatic latent image that has moved to a development position (a position opposed to the developing device 14) is converted into the Y image (the first color toner image), which is a visible image, by the developing device 14. The toner (the Y toner) formed of resin containing pigment is stored in the developing device. The Y toner is agitated in the developing device 14 to be triboelectrically charged to be charged in the same polarity as the charges on the surface of the photoconductive drum 11. In the case of this embodiment, the Y toner is charged in a negative polarity.

A large amount of negative charges remain in a surface area of the photoconductive drum 11 on which the light is not irradiated. The toner is not charged in this area because of a direction of an electric field. On the other hand, a surface potential falls in a zero potential direction in the area on which the light is irradiated and the Y toner charged in the negative polarity adheres to the area. In this way, the Y image is formed on the photoconductive drum 11.

An example of a method of positioning the M image and the Y image in transferring the images onto the first color intermediate transfer drum 51 will be explained.

As described above, this positioning is performed according to adjustment of exposure timings of the exposing device 13 and the exposing device 23. Specifically, first, linear test patterns M and Y are formed on the photoconductive drums 11 and 21, respectively, and transferred onto the first color intermediate transfer drum 51. A not-shown image position detection sensor is provided near the first color intermediate transfer drum 51. The image position detection sensor has, for example, a reference light irradiating unit that irradiates a near infrared ray and a reflected light detecting unit that detects reflected light. A light absorption amount is different in the area on which the toner is transferred and the area on which the toner is not transferred on the surface of the first color intermediate transfer drum 51. Thus, it is possible to detect the transferred test patterns M and Y with the image position detection sensor. For example, when the two test patterns are formed with both the widths thereof set to 100 μm, if both the test patterns are completely superimposed on each other, the width of the test pattern detected by the image position detection sensor is 100 μm. On the other hand, when a position of the test pattern M and a position of the test pattern Y deviate from each other, the width of both the test patterns superimposed on each other is larger than 100 μm.

Thus, exposure timings of the exposing device 13 and the exposing device 23 are adjusted with one of the exposure timings as a reference such that the width of the test patterns after the superimposition detected by the image position detection sensor is in a predetermined error range, i.e., equal to or smaller than 120 μm. Consequently, it is possible to keep positional deviation between the M image and the Y image to be equal to or smaller than ±20 μm.

Positioning of the K image and the C image and positioning of the (Y+M) image and the (C+K) image performed on the second color intermediate transfer drum 52 are performed in the same manner.

Finally, positional deviation in a test pattern of the full-color (the (Y+M+C+K) image) is adjusted to be equal to or smaller than ±20 μm.

The position adjustment may be performed by providing a test period for exclusive use before an operation of the image forming apparatus 1 for actually printing an original or may be appropriately adjusted by generating a test pattern between images during the printing operation for the original.

According to the position adjustment using the test patterns, the (Y+M+C+K) image during a normal operation formed on the second color intermediate transfer drum 52 is also formed as a full-color image without positional deviation.

The (Y+M+C+K) image on the first color intermediate transfer drum 52 is transferred onto the recording paper 104 (or 103) in a contact nip section in contact with the second transfer roller 54.

The recording paper 104 and the recording paper 103 are partitioned into two by a partition plate 110 and stored in the paper feeding unit 4. A sensor (not shown) that detects presence or absence of recording paper is provided in the paper feeding unit 4. For example, when the recording paper 104 is fully consumed, the recording paper 103 is used.

The recording paper 104 (or 103) is taken out from the paper feeding unit 4 one by one and inputted to a conveyance guide 107 by a pickup roller 105. The pickup roller 105 is made of, for example, urethane rubber. The recording paper 104 (or 103) is guided by the conveyance guide 107 and reaches the contact nip section formed by the second color intermediate transfer drum 52 and the second transfer roller 54.

In this contact nip section, a transfer device 57 is disposed on an inner side of the second transfer roller 54 and an earth roller 101 having a zero potential is disposed on an inner side of the second color intermediate transfer drum 52 to be opposed to each other.

When a positive potential of, for example, +1000 V is applied to the transfer device 57, the toner image of the (Y+M+C+K) image charged in the negative polarity is transferred onto the recording paper 104 (or 103).

After being transferred onto the recording paper 104 (or 103), the toner remaining on the surface of the second transfer roller 54 is collected in the waste toner box 102 as a waste toner. The toner remaining on the surfaces of the three intermediate transfer drums 51, 52, and 53 is also removed by the cleaning supporting device 60 and finally collected in the waste toner box 102.

On the other hand, the recording paper 104 (or 103) onto which the (Y+M+C+K) image is transferred is conveyed to the fixing unit 6 by a not-shown conveying roller. The fixing unit 6 heats and presses the recording paper 104 (or 103) to fix the (Y+M+C+K) image.

The recording paper 104 (or 103) having the image fixed thereon is further conveyed by the not-shown conveying roller and stored in the paper discharge tray 5.

Figure 2:
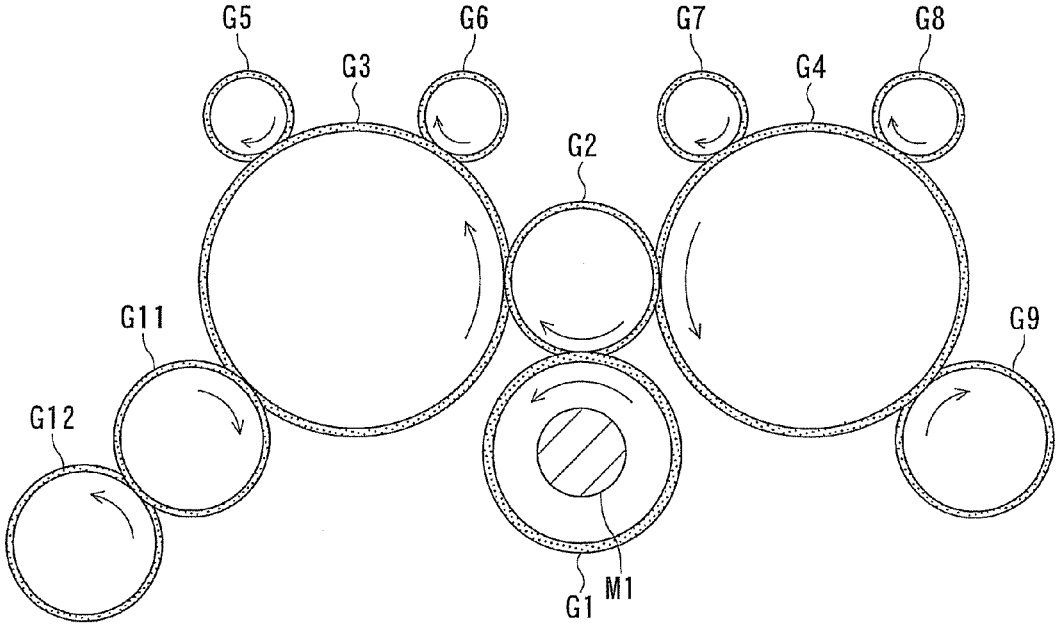
FIG. 2 is a diagram showing an example of a structure of a driving system according to the first embodiment of the present invention.

The driving system of the image forming apparatus 1 will be explained. FIG. 2 is a diagram schematically showing only the driving system of the image forming apparatus 1.

A gear G1 is coupled to a shaft of a driving motor M1 in a center axis thereof and rotates in, for example, a counterclockwise direction with a rotation driving force of the driving motor M1. The gear G1 has a diameter of about 50 mm and is, for example, a gear made of Delrin with the teeth number 50.

A gear G2 is a gear made of Delrin with the teeth number 25 pressed into one end of the third color intermediate transfer drum 53 having a diameter of about 25 mm. The gear G2 is driven by the gear G1, which meshes with the gear G2, to rotate in a clockwise direction.

A gear G3 and a gear G4 are gears pressed into one ends of the first color intermediate transfer drum 51 having a diameter of about 50 mm and the second color intermediate transfer drum 52, respectively, and are gears made of Delrin with the teeth number 50. The gears G3 and G4 are driven by the gear G2 to rotate in the counterclockwise direction.

A gear G5 and a gear G6 are gears made of Delrin with the teeth number 20 pressed into one ends of the photoconductive drums 11 and 21 having a diameter of about 20 mm. The gear G5 and the gear G6 are driven by the gear G3 to rotate in the clockwise direction.

A gear G7 and a gear G8 are also gears made of Delrin with the teeth number of 20 pressed into one ends of the photoconductive drums 31 and 41 having a diameter of about 20 mm. Both the gear G7 and the gear G8 are driven by the gear G4 to rotate in the clockwise direction.

A gear G9 is a gear made of Delrin with the teeth number 25 pressed into one end of the second transfer roller 54. The gear G9 is driven by the gear G4 to rotate in the clockwise direction.

A gear G11 is a gear made of Delrin with the teeth number 25 pressed into one end of the cored bar roller 59. The gear G11 is driven by the gear G3 to rotate in the clockwise direction.

A gear G12 is a gear made of Delrin with the teeth number 25 pressed into one end of the first transfer roller 159. The gear G12 is driven by the gear G1 to rotate in the counterclockwise direction.

As described above, all the gears G2 to G12 are driven by the gear G1 coupled to the motor M1 and constitute a synchronized and well-balanced driving system as a whole.

As described above, in the image forming apparatus 1 according to this embodiment, the color printing unit 2 and the monochrome printing unit 3 are interchangeable.

Figure 3:
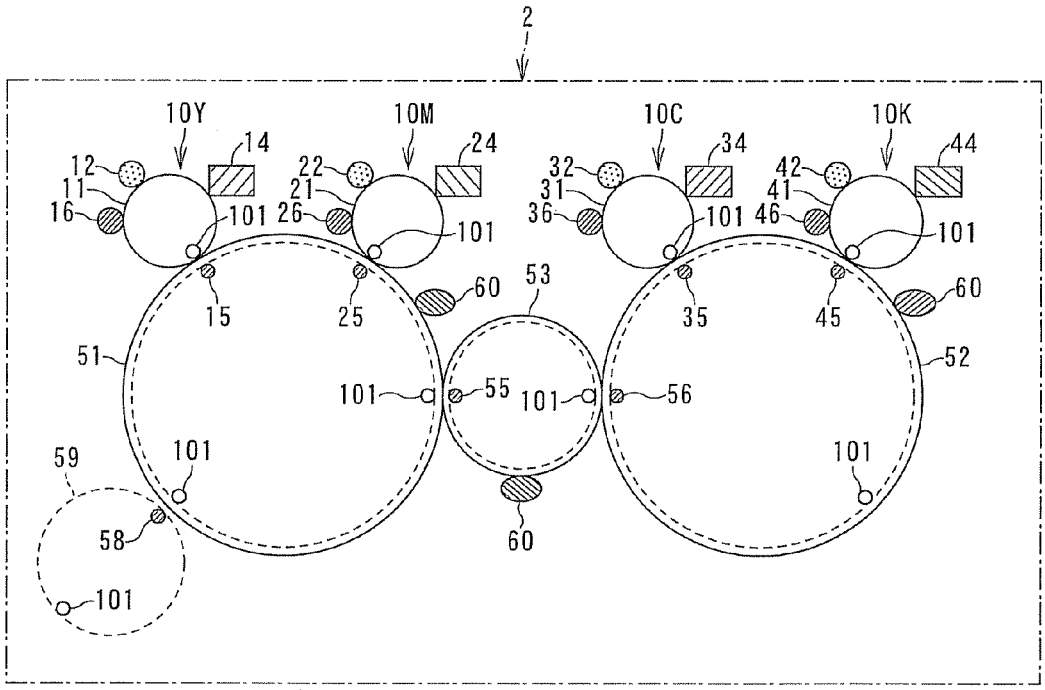
FIG. 3 is a diagram showing an example of a structure of the color printing unit according to the first embodiment of the present invention.
Figure 4:
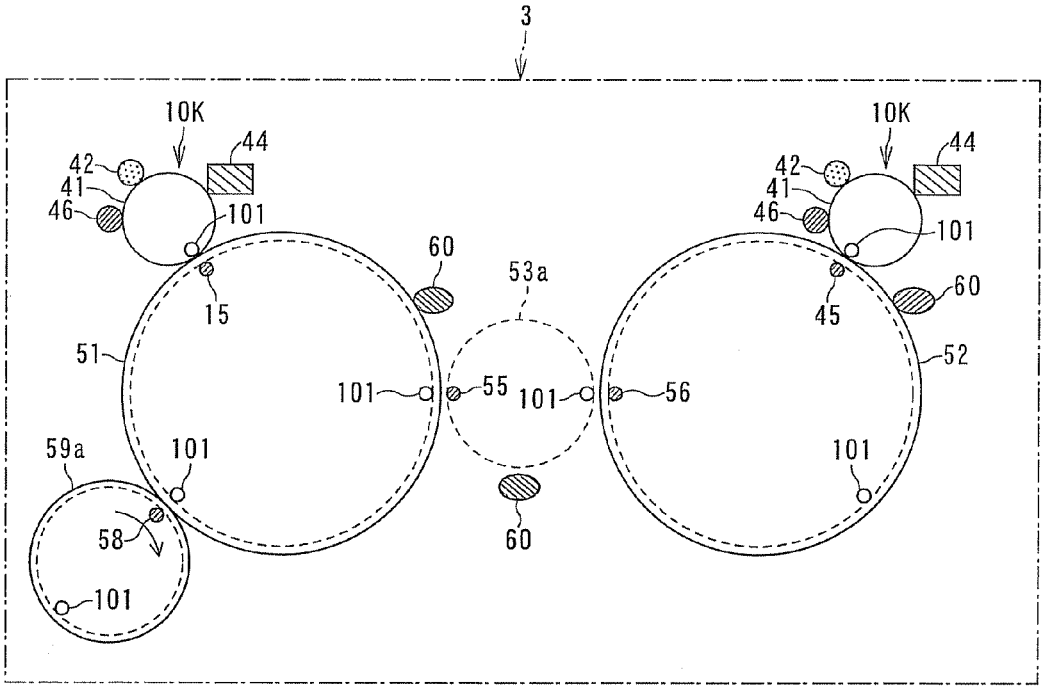
FIG. 4 is a diagram showing an example of a structure of a monochrome printing unit according to the first embodiment of the present invention.

FIG. 3 is a diagram showing an example of a structure of the color printing unit 2. FIG. 4 is a diagram showing an example of a structure of the monochrome printing unit 3. Both the printing units are different mainly in the following three points.

A first difference is the number and types of toner-image forming units. Whereas toner-image forming units corresponding to the four printing colors, i.e., the first to fourth toner-image forming units 10Y, 10M, 10C, and 10K, are provided in the color printing unit 2 in FIG. 3, two monochrome-image forming units 10K are provided in the monochrome printing unit 3.

A second difference is that, whereas the third color intermediate transfer drum 53 is provided in the center in the color printing unit 2 in FIG. 3, a cored bar roller 53*a* constituted by only a core bar of the third color intermediate transfer drum 53 is provided in the monochrome printing unit 3 in FIG. 4. The corer bar roller 53*a* is a component before a polyimide resin sheet is wound around the surface of the third color intermediate transfer drum 53.

Since the polyimide resin sheet is not present, in the monochrome transfer unit 3, transfer of a toner from the first color intermediate transfer drum 51 to the second color intermediate transfer drum 52 is completely shut off.

A third difference is that, whereas the cored bar roller 59 of the color printing unit 2 in FIG. 3 is a roller with only a core bar around which the polyimide resin sheet is not wound, the polyimide resin sheet is wound around an intermediate transfer roller 59*a* of the monochrome printing unit 3 in FIG. 4. Therefore, during color printing, the toner is not transferred from the first color intermediate transfer drum 51 to the cored bar roller 59 and, conversely, during monochrome printing, the toner (the K image) is transferred from the first color intermediate transfer drum 51 (in this case, the first monochrome intermediate transfer drum 51) to the intermediate transfer roller 59*a*.

In the color printing unit 2 and the monochrome printing unit 3, components used therein are substantially the same except three differences described above. In other words, the first color intermediate transfer drum 51, the second color intermediate transfer drum 52, a first monochrome intermediate transfer drum 51, and a second monochrome intermediate transfer drum 52 are components having the same dimension, shape, structure, and the like.

The third color intermediate transfer drum 53 and the cored bar roller 53*a* are substantially the same components and the cored bar roller 59 and the intermediate transfer roller 59*a* are substantially the same components, which are different only in presence or absence of polyimide resin on the surfaces thereof.

In this way, many components are common to the color printing unit 2 and the monochrome printing unit 3. Materials and manufacturing processes thereof are also substantially the same. Therefore, development cost and manufacturing cost for the components are reduced. As a result, this contributes to a reduction in cost of the entire apparatus.

Since the components are not only common but are substantially the same in external appearances and arrangements thereof, it is possible to share a mechanism of the driving system for driving the drums, the rollers, and the like without changing the mechanism.

Figure 5:
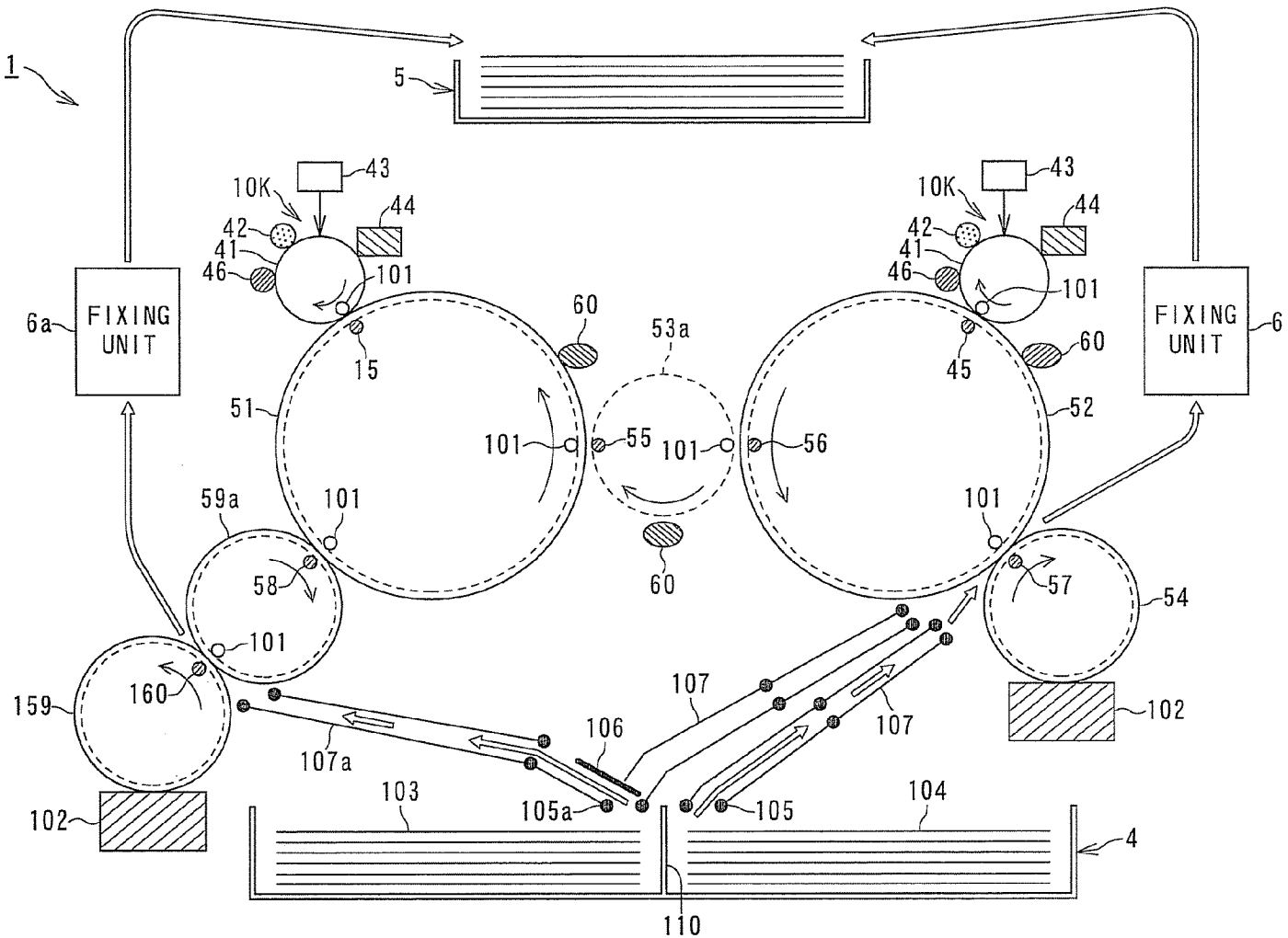
FIG. 5 is a diagram showing an example of a structure at the time when the monochrome printing unit is mounted in the image forming apparatus according to the first embodiment of the present invention.

(2) A Structure and Operations of the Image Forming Apparatus at the Time when the Monochrome Unit is Mounted Thereon FIG. 5 is a diagram showing an example of a structure of the image forming apparatus 1 at the time when the monochrome printing unit 3 is mounted thereon. A characteristic of this structure is that the monochrome printing is performed by two systems substantially simultaneously and in parallel with each other to double speed of the monochrome printing.

Naturally, it is also possible to perform the monochrome printing at the time when the color printing unit 2 is mounted. It is possible to perform the monochrome printing by causing only the fourth toner-image forming unit 10K for black to operate among the first to fourth toner-image forming units 10Y, 10M, 10C, and 10K.

However, in this case, printing speed of the monochrome printing is substantially the same as speed of the color printing.

On the other hand, when the monochrome printing unit 3 according to this embodiment is mounted, it is possible to perform monochrome printing at speed about twice as high as the speed of the color printing.

A monochrome printing operation at the time when the monochrome printing unit 3 is mounted is as follows.

First, in first and second monochrome-image forming units 10K on the left and right, monochrome toner images (K images) are formed on the photoconductive drums 41 thereof substantially simultaneously and in parallel with each other. When a document including plural pages is continuously printed, for example, the first monochrome-image forming unit 10K on the left takes charge of odd number pages and the second monochrome-image forming unit 10K on the right prints takes charge of even number pages.

The K image formed by the first monochrome-image forming unit 10K is transferred onto the first monochrome intermediate transfer drum 51 on the left side. Thereafter, this K image is transferred onto the intermediate transfer roller 59*a* and moves to a contact nip section in contact with the first transfer roller 159.

Substantially in parallel with this, the K image formed by the second monochrome-image forming unit 10K is transferred onto the second monochrome intermediate transfer drum 52 on the right side and moves to a contact nip section in contact with the second transfer roller 54.

Since the polyimide resin sheet is not wound around the cored bar roller 53*a* in the middle, transfer of the toner does not occur between the first and second monochrome intermediate transfer drums 51 and 52. Thus, the K images on the first and second monochrome intermediate transfer drums 51 and 52 do not interfere with each other.

Since transfer processes on the left and right are independent from each other, strict positioning like that in the case of the color printing is unnecessary.

On the other hand, recording paper 104 stored on the right side of the paper feeding unit 4 is taken out by the pickup roller 105 and conveyed to the contact nip section of the second transfer roller 54 through the conveyance guide 107.

The K image (e.g., the K image of an even number page) is transferred onto the recording paper 104 in this contact nip section and thereafter fixed by the fixing unit (a second fixing unit) 6. The recording paper 104 having the K image fixed thereon is discharged to the paper discharge tray 5.

On the other hand, substantially in parallel with this, the recording paper 103 stored on the left of the paper feeding unit 4 is taken out by the pickup roller 105*a* and conveyed to the contact nip section of the first transfer roller 159 through the conveyance guide 107*a*.

At the time when the monochrome printing unit 3 is mounted, a sheet guide plate 106 is slid to the right side by a not-shown driving motor. Thus, the recording paper 103 on the left side does not enter the conveyance guide 107 on the right side.

The K image (e.g., the K image of an odd number page) is transferred onto the recording paper 103 in the contact nip section of the first transfer roller 159 and thereafter fixed by a fixing unit (a first fixing unit) 6*a*. The recording paper 103 having the K image fixed thereon is discharged to the paper discharge tray 5.

Flows of the recording paper 103 and the recording paper 104 are not limited to the flows shown in FIG. 5. However, it is necessary to prevent the two flows from colliding with each other. For example, as shown in FIG. 5, a conveyance path only has to be established such that the recording paper 103 and the recording paper 104 flow to outer sides in opposite directions each other after the transfer. Therefore, in this embodiment, the intermediate transfer roller 59*a* is provided between the first monochrome intermediate transfer drum 51 and the first transfer roller 159 such that the recording paper 103 passing through the contact nip section flows to the outer side.

Since the intermediate transfer roller 59*a* is provided, the number of times of transfer by the system on the left side is larger than the number of times of transfer by the system on the right side by one. Therefore, the K image formed on the photoconductive drum 41 on the right side may be a non-reverse image but the K image formed on the photoconductive drum 41 on the left side needs to be a reverse image. However, since the non-reverse image and the reverse image are interchangeable by simple processing by software, this is not a significant problem.

The paper discharge tray 5 is constituted such that the recording paper 103 and the recording paper 104 are discharged in opposite directions each other. With this structure, it is possible to advance the two flows substantially simultaneously and in parallel with each other.

When the recording paper 103 and the recording paper 104 are discharged to the paper discharge tray 5 from both the sides, it is likely that the recording paper 103 and the recording paper 104 collide with each other to be turned up. In order to prevent this turn-up of paper, it is preferable to not completely set timings of discharge of both the kinds of paper completely the same and to adjust paper discharge timings such that the recording paper 103 and the recording paper 104 are discharged to be alternately placed on each other. It is possible to perform this timing adjustment according to timing adjustment for exposure by the exposing device 43 and timing adjustment for paper feeding by the paper feeding unit 4.

(3) Other Embodiments

Figure 6:
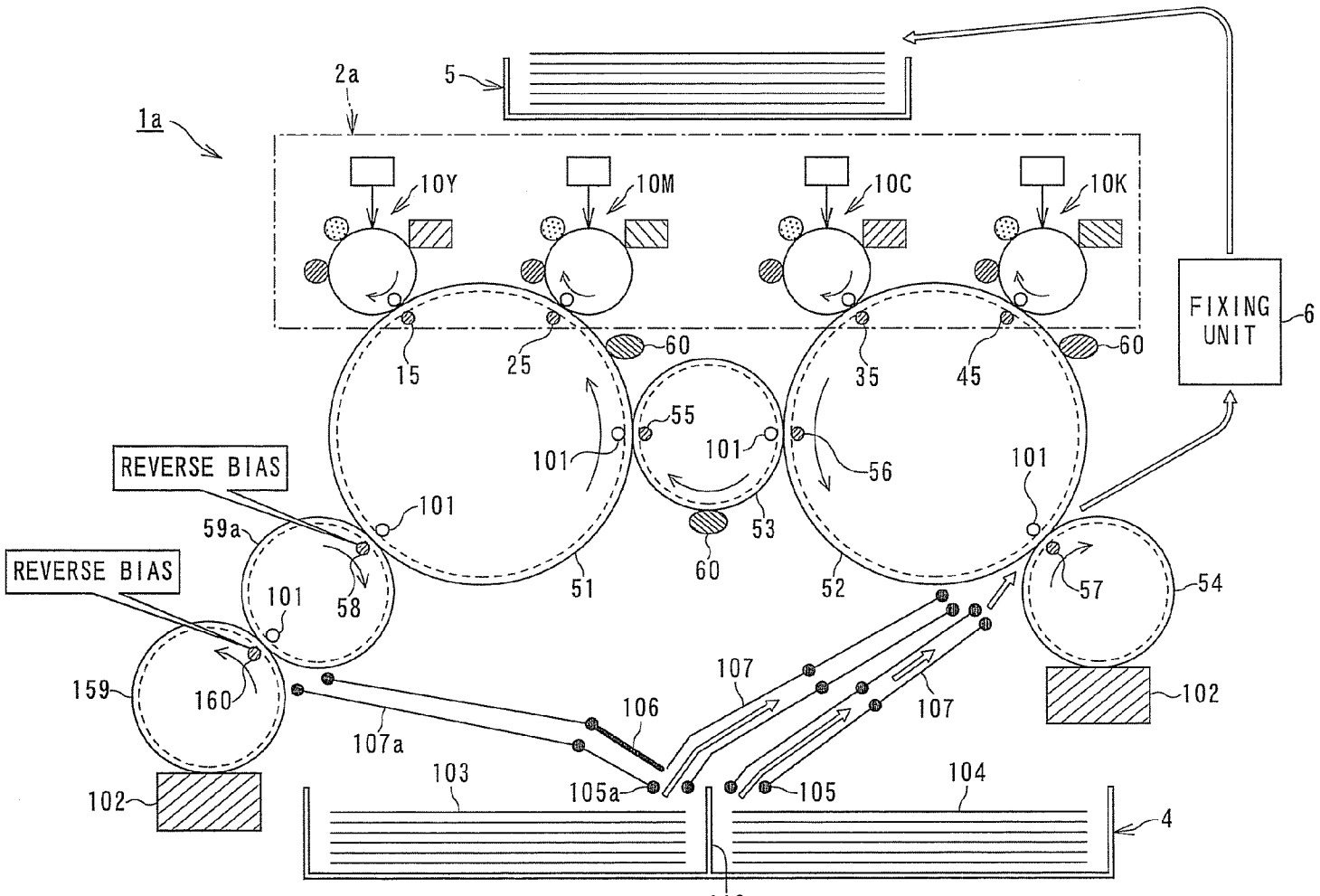
FIG. 6 is a diagram showing an example of a structure at the time when a color printing unit is mounted in an image forming apparatus according to a second embodiment of the present invention.

FIG. 6 is a diagram showing an example of a structure at the time when a color printing unit 2*a* is mounted in an image forming apparatus 1*a* according to a second embodiment.

In the first embodiment, the (Y+M) image is prevented from unnecessarily being transferred onto the first transfer roller 159 side by providing the cored bar roller 59, from which the polyimide resin sheet is removed, between the first color intermediate transfer drum 51 and the first transfer roller 159.

On the other hand, in the second embodiment, the intermediate transfer roller 59*a* around which the polyimide resin sheet is wound is disposed instead of the cored bar roller 59 and a reverse bias is applied to the transfer device 58 and a transfer device 160. Usually, a toner is charged in a negative polarity. In this embodiment, a toner is charged in a negative polarity.

When transfer is performed, as described above, a bias voltage of, for example, about +1000 V is applied to a transferred side to attract the toner to the transferred side. On the other hand, when a reverse bias (in this case, an appropriate negative voltage) is applied to a transfer device, repulsion from the transferred side acts on the toner and the transfer is not performed.

In the second embodiment, by applying a negative reverse bias voltage to a transfer device 58 and the transfer device 160, the transfer is not performed even in a state in which the polyimide resin sheet is wound around the intermediate transfer roller 59*a*.

As a result, it is possible to adopt completely the same components as the intermediate transfer rollers 59*a* of the color printing unit 2 and the monochrome printing unit 3.

Figure 7:
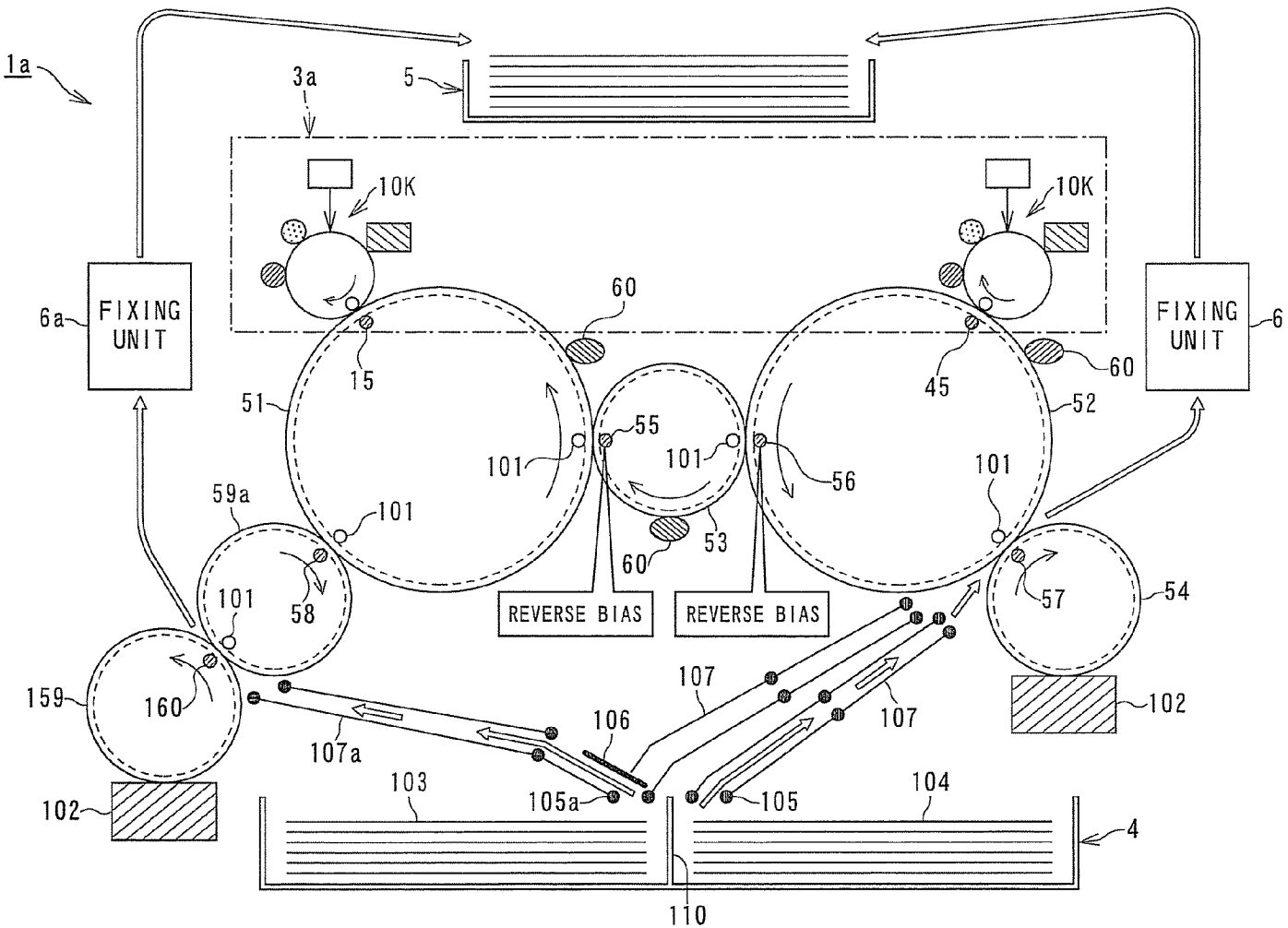
FIG. 7 is a diagram showing an example of a structure at the time when a monochrome printing unit is mounted in the image forming apparatus according to the second embodiment of the present invention.

FIG. 7 is a diagram showing an example of a structure at the time when a monochrome printing unit 3*a* is mounted in the image forming apparatus 1*a* according to the second embodiment.

In the first embodiment, the K image of the system on the left side and the K image of the system on the right side are prevented from interfering with each other by providing the cored bar roller 53*a*, from which the polyimide resin sheet is removed, between the first monochrome intermediate transfer drum 51 and the second monochrome intermediate transfer drum 52.

On the other hand, in the second embodiment, a component same as the third color intermediate transfer drum 53 around which the polyimide resin sheet is wound is disposed instead of the cored bar roller 53*a* and a negative reverse bias is applied to the transfer device 55 and a transfer device 56. With this structure, a toner is not transferred from the first monochrome intermediate transfer drum 51 to the second monochrome intermediate transfer drum 52. Thus, it is possible to prevent interference between the K image of the system on the left side and the K image of the system on the right side.

With the structure described above, in the image forming apparatus 1*a* according to the second embodiment, components that can be shared during the color printing and during the monochrome printing are increased and different components are substantially only toner-image forming units.

Therefore, it is possible to constitute the color printing unit 2*a* as a unit of interchange to include, as shown in FIG. 6, only the first to fourth toner-image forming units 10Y, 10M, 10C, and 10K. Similarly, it is possible to constitute the monochrome printing unit 3*a* to include, as shown in FIG. 7, only the first and second two toner-image forming units 10K.

As explained above, in the image forming apparatus 1 according to this embodiment, it is possible to increase speed of the monochrome printing at the time when the monochrome printing unit 3 is mounted to be about twice as high as printing speed during the color printing.

Components used in the color printing unit 2 and the monochrome printing unit 3 as units of interchange are substantially the same. Therefore, in addition to a reduction in component development cost, it is possible to reduce cost by using common component manufacturing steps and the like. Further, this is advantageous from the viewpoint of maintenance such as component replacement.

The color printing unit 2 and the monochrome printing unit 3 may be option units. A user who uses the monochrome printing more often than the color printing can also acquire the image forming apparatus 1 in which only the monochrome printing unit 3 is mounted.

The present invention is not limited to the embodiments per se. In an implementation stage, it is possible to modify and embody components without departing from the spirit of the present invention. It is possible to form various embodiments of the invention by appropriately combining the plural components disclosed in the embodiments. For example, several components may be deleted from all the components described in the embodiments. Moreover, the components described in different embodiments may be appropriately combined.

What is claimed is:

1. An image forming apparatus comprising:

a first toner-image forming unit configured to form a first monochrome toner image;

a first intermediate transfer drum onto which the first monochrome toner image is transferred;

a first transfer unit configured to transfer the first monochrome toner image from the first intermediate transfer drum onto first recording paper;

a second toner-image forming unit configured to form a second monochrome toner image substantially simultaneously and in parallel with the formation of the first toner image;

a second intermediate transfer drum onto which the second monochrome toner image is transferred;

a second transfer unit configured to transfer the second monochrome toner image from the second intermediate transfer drum onto second recording paper;

a paper feeding unit configured to feed the first recording paper and the second recording paper to the first transfer unit and the second transfer unit, respectively, substantially simultaneously and in parallel with each other;

a first fixing unit configured to fix the transferred first monochrome toner image on the first recording paper;

a second fixing unit configured to fix the transferred second monochrome toner image on the second recording paper; and a paper discharge tray to which the first recording paper having the first monochrome toner image fixed thereon by the first fixing unit and the second recording paper having the second monochrome toner image fixed thereon by the second fixing unit are discharged, wherein the first recording paper and the second recording paper are discharged to the paper discharge tray substantially simultaneously and in parallel with each other from opposite directions each other.

2. An image forming apparatus according to claim 1, wherein the paper feeding unit feeds, when the first recording paper and the second recording paper are continuously fed, the first recording paper and the second recording paper such that the first recording paper and the second recording paper are discharged to be alternately placed on each other in the paper discharge tray.

3. An image forming unit comprising:

a color printing unit configured to be mounted when color printing is performed;

a monochrome printing unit configured to be mounted in place of the color printing unit when monochrome printing is performed;

a first transfer unit;

a second transfer unit; and a paper feeding unit configured to feed recording paper to at least one of the first transfer unit and the second transfer unit, wherein the monochrome printing unit includes:

a first toner-image forming unit configured to form a first monochrome toner image;

a first intermediate transfer drum onto which the first monochrome toner image is transferred;

a second toner-image forming unit configured to form a second monochrome toner image substantially simultaneously and in parallel with the formation of the first toner image; and a second intermediate transfer drum onto which the second monochrome toner image is transferred, and when the monochrome printing unit is mounted, the paper feeding unit feeds the first recording paper and the second recording paper to the first transfer unit and the second transfer unit, respectively, substantially simultaneously and in parallel with each other, the first transfer unit transfers the first monochrome toner image from the first monochrome intermediate transfer drum to the first recording paper, and the second transfer unit transfers the second monochrome toner image from the second monochrome intermediate transfer drum to the second recording paper.

4. An image forming apparatus according to claim 3, wherein the color printing unit includes:

a first toner-image forming unit configured to form a first color toner image;

a second toner-image forming unit configured to form a second color toner image;

a first color intermediate transfer drum onto which the first color toner image and the second color toner image are transferred to be superimposed on each other;

a third toner-image forming unit configured to form a third color toner image;

a fourth toner-image forming unit configured to form a fourth color toner image;

a second color intermediate transfer drum onto which the third color toner image and the fourth color toner image are transferred to be superimposed on each other; and a third color intermediate transfer drum configured to be disposed between the first color intermediate transfer drum and the second intermediate transfer drum, transfer a superimposed image of the first and second color toner images transferred onto the first color intermediate transfer drum to be further superimposed on a superimposed image of the third and fourth color toner images transferred onto the second color intermediate transfer drum, and form a full-color toner image on the second color intermediate transfer drum, wherein when the color printing unit is mounted, the paper feeding unit feeds recording paper to the first transfer unit, and the first transfer unit transfers the full-color toner image formed on the second color intermediate transfer drum onto the recording paper.

5. An image forming apparatus according to claim 4 wherein the first color intermediate transfer drum, the second color intermediate transfer drum, the first monochrome intermediate transfer drum, and the second monochrome intermediate transfer drum are constituted using substantially the same intermediate transfer drums.

6. An image forming apparatus according to claim 5, wherein the monochrome printing unit has, between the first monochrome intermediate transfer drum and the second monochrome intermediate transfer drum, a third drum that is substantially the same the third color intermediate transfer drum except that the third drum does not perform transfer.

7. An image forming apparatus according to claim 6, further comprising a driving unit configured to drive to rotate the first monochrome intermediate transfer drum and the second monochrome intermediate transfer drum via the third drum when the monochrome printing unit is mounted and drive to rotate the first color intermediate transfer drum and the second color intermediate transfer drum via the third color intermediate transfer drum when the color printing unit is mounted.

8. An image forming apparatus according to claim 7, wherein the first transfer unit includes a first transfer roller configured to follow the first monochrome intermediate transfer drum or the first color intermediate transfer drum, the second transfer unit includes an intermediate transfer roller configured to follow the first monochrome intermediate transfer drum and a second transfer roller configured to further follow the intermediate transfer roller, and when the monochrome printing unit is mounted, the first recording paper having the first monochrome image transferred thereon is conveyed upward through a nip section formed by the first monochrome intermediate transfer drum and the first transfer roller and the second recording paper having the second monochrome image transferred thereon is conveyed upward through a nip section formed by the intermediate transfer roller and the second transfer roller.

9. An image forming apparatus according to claim 8, wherein the first monochrome toner image formed by the first toner image forming unit is a non-reverse image, and the second monochrome toner image formed by the second toner image forming unit is a reverse image.

10. An image forming method comprising:

(a) forming a first monochrome toner image;

(b) transferring the formed first monochrome toner image onto a first intermediate transfer drum;

(c) transferring, in a first transfer unit, the transferred first monochrome toner image from the first intermediate transfer drum to first recording paper;

(d) forming a second monochrome toner image substantially simultaneously and in parallel with the formation of the first toner image;

(e) transferring the formed second monochrome toner image onto a second intermediate transfer drum;

(f) transferring, in a second transfer unit, the transferred second monochrome toner image from the second intermediate transfer drum onto second recording paper;

(g) feeding the first recording paper and the second recording paper to the first transfer unit and the second transfer unit, respectively, substantially simultaneously and in parallel with each other;

(h) fixing the transferred first monochrome toner image on the first recording paper;

(i) fixing the transferred second monochrome toner image on the second recording paper; and (j) discharging the first recording paper having the first monochrome toner image fixed thereon by a first fixing unit and the second recording paper having the second monochrome toner image fixed thereon by a second fixing unit to a paper discharge tray, wherein in step (j), the first recording paper and the second recording paper are discharged to the paper discharge tray substantially simultaneously and in parallel with each other from opposite directions each other.

11. An image forming method according to claim 10, wherein, in step (g), when the first recording paper and the second recording paper are continuously fed, the first recording paper and the second recording paper are fed at timing when the first recording paper and the second recording paper are discharged to be alternately placed on each other in the paper discharge tray.

12. An image forming method according to claim 10, wherein the first transfer unit includes a first transfer roller that follows the first monochrome intermediate transfer drum or the first color intermediate transfer drum, the second transfer unit includes an intermediate transfer roller that follows the first monochrome intermediate transfer drum and a second transfer roller that further follows the intermediate transfer roller, and the image forming method further includes;

(k) conveying the first recording paper having the first monochrome image transferred thereon upward through a nip section formed by the first monochrome intermediate transfer drum and the first transfer roller and conveying the second recording paper having the second monochrome image transferred thereon upward through a nip section formed by the intermediate transfer roller and the second transfer roller.

13. An image forming method according to claim 12, wherein the first monochrome toner image formed in step (a) is a non-reverse image, and the second monochrome image formed in step (d) is a reverse image.

* * * * *